US011098272B2

(12) United States Patent
Chao

(10) Patent No.: US 11,098,272 B2
(45) Date of Patent: Aug. 24, 2021

(54) WASHING PRODUCT

(71) Applicant: Hua-Chun Chao, Taipei (TW)

(72) Inventor: Hua-Chun Chao, Taipei (TW)

( * ) Notice: Subject to any disclaimer, the term of this patent is extended or adjusted under 35 U.S.C. 154(b) by 105 days.

(21) Appl. No.: 16/521,303

(22) Filed: Jul. 24, 2019

(65) Prior Publication Data

US 2021/0024859 A1 Jan. 28, 2021

(51) Int. Cl.

| | |
|---|---|
| ***C11D 7/44*** | (2006.01) |
| ***C11D 7/12*** | (2006.01) |
| ***C11D 7/26*** | (2006.01) |
| ***C11D 17/06*** | (2006.01) |
| ***C11D 11/00*** | (2006.01) |
| ***C11D 3/20*** | (2006.01) |
| ***C11D 3/10*** | (2006.01) |
| ***C11D 3/22*** | (2006.01) |
| ***C11D 3/382*** | (2006.01) |

(52) U.S. Cl.

CPC ..... *C11D 17/06* (2013.01); *C11D 3/10* (2013.01); *C11D 3/2082* (2013.01); *C11D 3/222* (2013.01); *C11D 3/382* (2013.01); *C11D 11/0082* (2013.01)

(58) Field of Classification Search

None

See application file for complete search history.

(56) References Cited

U.S. PATENT DOCUMENTS

2014/0155337 A1* 6/2014 Ford ..... A01N 65/00 514/26
2017/0320764 A1* 11/2017 De Boer ..... C11D 3/0052

FOREIGN PATENT DOCUMENTS

CN 108822978 A * 11/2018
CN 109055042 A * 12/2018

* cited by examiner

*Primary Examiner* — Lorna M Douyon

(74) *Attorney, Agent, or Firm* — Muncy, Geissler, Olds & Lowe, P.C.

(57) ABSTRACT

A washing product is provided, including a first powder comprising a camellia-seed powder, and a soybean powder with 55% to 95% by weight of a total weight of the washing product, a second powder such as sodium hydrogen carbonate with 5% to 25% by weight of a total weight of the washing product, and a third powder such as citric acid with 1% to 20% by weight of a total weight of the washing product. The washing product further includes a fourth powder comprising starch, protein, cellulose, and/or sodium carboxymethyl cellulose with 1% to 20% by weight of a total weight of the washing product. The washing product is made from plant-based materials with biodegradability, non-toxicity and low-carbon property.

6 Claims, No Drawings

WASHING PRODUCT

FIELD OF THE INVENTION

The present invention relates to household supplies, and more particularly to a washing product.

BACKGROUND OF THE INVENTION

Most washing products on the market are petrochemical and toxic. For example, a laundry detergent or a dishwashing detergent is usually made from artificial synthetic chemical compounds, such as surfactant. The artificial detergent residual on tableware, kitchenware, utensil, fruit, vegetable, a baby bottle and a pet bowl is harmful to humans and animals, and the toxic sewage is harmful to the environment and ecosystem.

Nowadays, more and more green consumers and environmentalists refuse to use non-ecofriendly products, and they value more sustainable, biodegradable, nontoxic and low-carbon products that made from natural, organic and plant-based materials.

SUMMARY OF THE INVENTION

Embodiments of the present disclosure may be directed to a washing product with a shape of a powder or a block adaptive to resolve the problem arising from environmental degradation in using the dishwashing detergent.

It is an objective of the invention is to provide a washing product essentially composed of a camellia-seed powder with 55% to 95% by weight of a total weight of the washing product.

It is another objective of the invention is to provide a washing product including a first powder, a second powder, and a third powder, wherein the first powder is 55% to 95% by weight of a total weight of the washing product, the second powder is 5% to 25% by weight of a total weight of the washing product, and the third powder is 1% to 20% by weight of a total weight of the washing product. Exemplarily, the first powder comprises a camellia-seed powder and a soybean powder, the second powder is sodium hydrogen carbonate, and the third powder is citric acid.

It is another objective of the invention is to provide a washing product including a first powder and a second powder, wherein the first powder is 55% to 95% by weight of a total weight of the washing product, and the second powder is 1% to 20% by weight of a total weight of the washing product. Exemplarily, the first powder comprises a camellia-seed powder and a soybean powder, the second powder comprises starch, protein, cellulose, and/or sodium carboxymethyl cellulose.

According to above objectives, the present invention provides a washing product which includes the camellia-seed powder with cleaning ability; further includes sodium hydrogen carbonate and citric acid which are reacted each other when contacting with water and bring about disintegration and dissolution. Consequently, the washing product may disintegrate and dissolve in water and is able to fully utilize its cleaning ability to wash tableware, kitchenware, utensil, fruit, vegetable, a baby bottle and a pet bowl.

DETAILED DESCRIPTION OF THE PREFERRED EMBODIMENT

The accompanying contents, which are incorporated in and constitute a part of this specification, illustrate the disclosed various embodiments, and together with the description, serve to explain the principles of the disclosed embodiments. As used herein, the terms "include," "comprises," or any other variation thereof, are intended to cover a non-exclusive inclusion, such that a process, method, article, or apparatus that comprises a list of elements does not include only those elements, but may include other elements not expressly listed or inherent to such process, method, article, or product.

In first embodiment, a washing product essentially composed of a camellia-seed powder with 55% to 95% by weight of a total weight of the washing product. Additionally, the washing product further comprises a soybean powder with 1% to 25% by weight of a total weight of the washing product. The washing product is a powder or a block.

The camellia-seed powder is rich in saponin. The saponin is an excellent natural nontoxic detergent. It has physical characteristics such as emulsifying, dispersing, and moistening so that the saponin is sometimes used to manufacture various kinds of emulsifier and detergent. Furthermore, aqueous solution containing the saponin has good surface activity, which can reduce the surface tension between oil and water, produce strong degreasing ability, and will not be affected by water hardness. Besides, the saponin is a natural compound that is easily bio-degraded into non-toxic substances by microorganism, which does not pollute the environment. Consequently, the washing products illustrated in various embodiments of the invention also have aforesaid advantages.

In another embodiment, the washing product further comprises a filler powder with 1% to 20% by weight of a total weight of the washing product. The filler powder is exemplarily starch, protein, cellulose, and/or sodium carboxymethyl cellulose. Sodium carboxymethyl cellulose has functionality of thickening, degreasing, and anti-redeposition.

In second embodiment, a washing product including a first powder, a second powder, and a third powder. The washing product is a powder or a block, in which the shape of block can be a cube, a cuboid, a parallelepiped, a prism, a pyramid, an antiprism, a polyhedron, a frustum, a cylinder, a cone, an ellipsoid, a sphere, a spherical cap, a spherical segment or an irregular object, but is not limited thereto. The first powder comprising a camellia-seed powder and a soybean powder is 55% to 95% by weight of a total weight of the washing product. The second powder is 5% to 25% by weight of a total weight of the washing product. The third powder is 1% to 20% by weight of a total weight of the washing product. The second powder is exemplary sodium hydrogen carbonate, and the third powder is exemplary citric acid.

More perfectly, the camellia-seed powder is 55% to 95% by weight of a total weight of the first powder; the soybean powder is 1% to 25% by weight of a total weight of the first powder.

Additionally, the second embodiment is the same as the first embodiment. The washing product further comprises a filler powder with 1% to 20% by weight of a total weight of the washing product. The filler powder is exemplarily starch, protein, cellulose, and/or sodium carboxymethyl cellulose.

In third embodiment, a washing product including a first powder and a second powder. The washing product is a powder or a block, in which the shape of block can be a cube, a cuboid, a parallelepiped, a prism, a pyramid, an antiprism, a polyhedron, a frustum, a cylinder, a cone, an ellipsoid, a sphere, a spherical cap, a spherical segment or an irregular object, but is not limited thereto. The first powder, comprising a camellia-seed powder and a soybean powder, is 55% to 95% by weight of a total weight of the washing product. The second powder comprising starch, protein, cellulose, and/or sodium carboxymethyl cellulose is 1% to 20% by weight of a total weight of the washing product.

More perfectly in the first powder, the camellia-seed powder is 55% to 95% by weight of a total weight of the first powder; the soybean powder is 1% to 25% by weight of a total weight of the first powder.

In another embodiment, the washing product further comprises a third powder with 5% to 25% by weight of a total weight of the washing product. The third powder is exemplary sodium hydrogen carbonate.

In another embodiment, the washing product further comprises a fourth powder with 1% to 20% by weight of a total weight of the washing product. The fourth powder is exemplary citric acid. It must be stated that the first powder, the second powder and the third powder in third embodiment aren't the same in the second embodiment.

Fabricating Procedure of the Washing Product

The first powder, the second powder, and the third powder are poured in a mold. For example, the mold may be formed of metal, wood or acrylic, but is not limited thereto. As long as it can withstand the pressure applied later, it can be used as the material of the mold. Then, at a temperature, for example, from about 15° C. to about 37° C. or from about 18° C. to about 25° C., a pressure is applied by the machine such as a range about 10 lbf/cm$^2$ to about 25 lbf/cm$^2$, about 14 lbf/cm$^2$ to about 20 lbf/cm$^2$ or about 16 lbf/cm$^2$ to about 18 lbf/cm$^2$ to compress the loose mixed powders in the mold to obtain a compact block washing product. The shape that the block washing product is compressed to a block, in which the shape of the block can be a cube, a cuboid, a parallelepiped, a prism, a pyramid, an antiprism, a polyhedron, a frustum, a cylinder, a cone, an ellipsoid, a sphere, a spherical cap, a spherical segment or an irregular object, but is not limited thereto. The shape could be selective according to need practical, as long as the shape is formed compactly. The size of the block washing product isn't limited, as long as it is suitable for handheld.

Components and amounts of Examples 1-3 is shown in Table 1 below, and Examples 2-3 are prepared by following the aforesaid procedure. The filler powder refers to comprise starch, protein, cellulose, and/or sodium carboxymethyl cellulose, and the better is sodium carboxymethyl cellulose. Example 1 is made into powder of the washing product without compressing and forming the block washing product. Amount of every component is represented as parts by weight based on per 100 parts by weight of the washing product.

TABLE 1

| Component | Example 1 | Example 2 | Example 3 |
|---|---|---|---|
| camellia-seed powder | 75 | 76 | 79 |
| soybean powder | 10 | 7 | 4 |
| filler powder | 15 | 3 | 2 |
| sodium hydrogen carbonate | 0 | 11 | 13 |
| citric acid | 0 | 3 | 2 |

From the above Table 1, it is noted that sodium hydrogen carbonate and citric acid will both react with water when the block washing product is immersed in water, then gas is generated such as carbon dioxide disintegrating the block washing product from a compact structure to a loose structure, and then disperse every kind of powder into water to form a detergent. Once the block washing product contact with water, the detergent is formed for washing the tableware, kitchenware, utensil, fruit, vegetable, a baby bottle and a pet bowl. The block washing product brings us convenience of life and portability.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A washing product consisting of:

a camellia-seed powder, the camellia-seed powder ranging from 55% to 95% by weight of a total weight of the washing product, a soybean powder ranging from 1% to 25% by weight of the total weight of the washing product, and a filler powder with the rest percentages by weight of the total weight of the washing product; and wherein the filler powder is selected from the group consisting of starch, protein, cellulose, sodium carboxymethyl cellulose, and a combination thereof.

2. The washing product according to claim 1, wherein the filler powder ranges from 1% to 20% by weight of the total weight of the washing product.

3. The washing product according to claim 1, wherein the washing product is a powder or a block.

4. A washing product consisting of a first powder, a second powder, a third powder, and optionally a fourth powder, wherein the first powder ranges from 55% to 95% by weight of a total weight of the washing product, the second powder ranges from 5% to 25% by weight of the total weight of the washing product, the third powder ranges from 1% to 20% by weight of the total weight of the washing product, wherein the first powder consists of a camellia-seed powder, and a soybean powder, wherein the camellia-seed powder ranges from 75% to 95% by weight of a total weight of the first powder, and the soybean powder ranges from 1% to 25% by weight of the total weight of the first powder; the second powder is sodium hydrogen carbonate; and the third powder is citric acid; and wherein the fourth powder is selected from the group consisting of starch, protein, cellulose, sodium carboxymethyl cellulose, and a combination thereof.

5. The washing product according to claim 4, wherein the fourth powder is present in the washing product and ranges from 1% to 20% by weight of the total weight of the washing product.

6. The washing product according to claim 4, wherein the washing product is a powder or a block.

* * * * *